US006293479B1

(12) United States Patent
Kaczmarski et al.

(10) Patent No.: US 6,293,479 B1
(45) Date of Patent: Sep. 25, 2001

(54) FEED CONTROL HYDRAULIC CIRCUIT FOR WOOD CHIPPER ATTACHMENT

(75) Inventors: Wally L. Kaczmarski; Verne C. Watts, both of Lisbon; David S. Majkrzak; Patrick M. Cronin, both of West Fargo, all of ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/450,171

(22) Filed: Nov. 29, 1999

(51) Int. Cl.[7] ..... B02C 25/00
(52) U.S. Cl. ..... 241/92; 241/101.2
(58) Field of Search ..... 241/34, 36, 37.5, 241/92, 101.2

(56) References Cited

U.S. PATENT DOCUMENTS

| | | | |
|---|---|---|---|
| 3,524,485 | | 8/1970 | Smith et al. . |
| 3,730,037 | | 5/1973 | Purrer . |
| 3,979,908 | | 9/1976 | Alderson . |
| 3,999,674 | | 12/1976 | Meitl . |
| 4,210,289 | | 7/1980 | Arnoldy . |
| 4,227,654 | | 10/1980 | Seefeld et al. . |
| 4,515,318 | | 5/1985 | Savonjousi . |
| 4,598,745 | | 7/1986 | Parviainen . |
| 4,633,776 | * | 1/1987 | Blackmore et al. . |
| 4,649,706 | | 3/1987 | Hutson . |
| 5,020,579 | | 6/1991 | Strong . |
| 5,088,532 | | 2/1992 | Eggers et al. . |
| 5,137,219 | * | 8/1992 | Morey . |
| 5,205,496 | * | 4/1993 | O'Donnell et al. . |
| 6,000,642 | * | 12/1999 | Morey . |

OTHER PUBLICATIONS

Advertising brochure re: Crary Bear Cat Chipper/Shredders (prior to Nov. of 1998).

Advertising brochure re: Crary Bear Cat Chippers, Chipper/Shredders, Vacuums & Stump Grinders for Home, Rental & Commercial Use (Sep. 1997).

* cited by examiner

*Primary Examiner*—Mark Rosenbaum
(74) *Attorney, Agent, or Firm*—Westman,Champlin & Kelly, P.A.

(57) ABSTRACT

A hydraulic circuit for a wood chipper attachment for a skid steer loader provides power to both a motor for driving a chipper wheel and a motor for driving a feed roller. A priority flow valve is provided to supply priority of flow to the chipper motor. As pressure increases on the chipper motor, the output from the skid steer loader pump reduces and the priority flow valve acts to reduce flow to the feed motor to reduce the infeed speed. The wood chipper is adapted to be mounted on a skid steer loader and utilize the hydraulic power source from the loader power source. A separate relief valve for the chipper wheel motor is set to relieve pressure if the chipper wheel motor stalls at a lower pressure than the relief valve for the hydraulic system on the skid steer loader so that the feed motor will have sufficient pressure for reversing the feed wheel.

17 Claims, 2 Drawing Sheets

FEED CONTROL HYDRAULIC CIRCUIT FOR WOOD CHIPPER ATTACHMENT

BACKGROUND OF THE INVENTION

The present invention relates to a wood chipper which includes a rotary chipper wheel, and a feed roller that will drive logs, branches and the like into the chipper wheel. The wheel and feed roller are driven by separate hydraulic motors, and the hydraulic circuit includes a flow priority valve that provides priority of flow to the chipper wheel motor, and includes a relief valve that is set so that the feed roller can be reversed if jams occur.

Various lock chippers have been advanced in the art, and problems with jamming the chipper wheel that is used have existed. For example, U.S. Pat. No. 3,524,485 shows a log chipping apparatus that has a rotatable chipping wheel and an infeed conveyor, with a speed sensing device for sensing changes in speed of rotation of the chipper wheel. The feeding conveyor is enabled or disabled in accordance with the changes in speed of the chipper wheel.

Drives for moving logs or pieces of wood into a chipping rotor that can be operated to retract the log either with the manual operation or at the time when the cutter speed drops below predetermined amount have been known, as shown in U.S. Pat. No. 4,598,745. This is sensitive to slowing of the chipper rotor or wheel, and reverses the drive of the log when the chipper wheel speed drops.

SUMMARY OF THE INVENTION

The present invention relates to a hydraulic circuit for driver of a wood chipper that will automatically control the flow to a motor for a chipper wheel and a motor for a feed roller as loads on the chipper wheel increase. The hydraulic motors to the chipper wheel and the feed roller, respectively, are provided with fluid under pressure from a hydraulic system on a skid steer loader on which the wood chipper is mounted. The hydraulic system includes a priority flow valve, which is a flow divider that will prioritize flows in a known manner, between the chipper wheel motor and the feed roller, so that initial flow will first be provided to the chipper wheel motor and excess flow to the feed roller motor. As loads increase on the chipper wheel the flow to the feed roller motor is reduced and the feed rate into the chipper wheel is reduced automatically.

Additionally, reversal of the feed roller to move a log or piece of wood away from the stalled chipper wheel is desirable and is accommodated by providing a relief valve setting for the motor for the chipper wheel that is lower than the main relief valve setting on the skid steer loader hydraulic system so that pressure continues to be available to the feed roller motor for reversing even if the chipper wheel jams and the relief valve to the chipper wheel motor opens.

The hydraulic system accommodates the attachment connections on the auxiliary hydraulic systems of a skid steer loader.

DETAILED DESCRIPTION OF THE PREFERRED EMBODIMENTS

Figure 1:
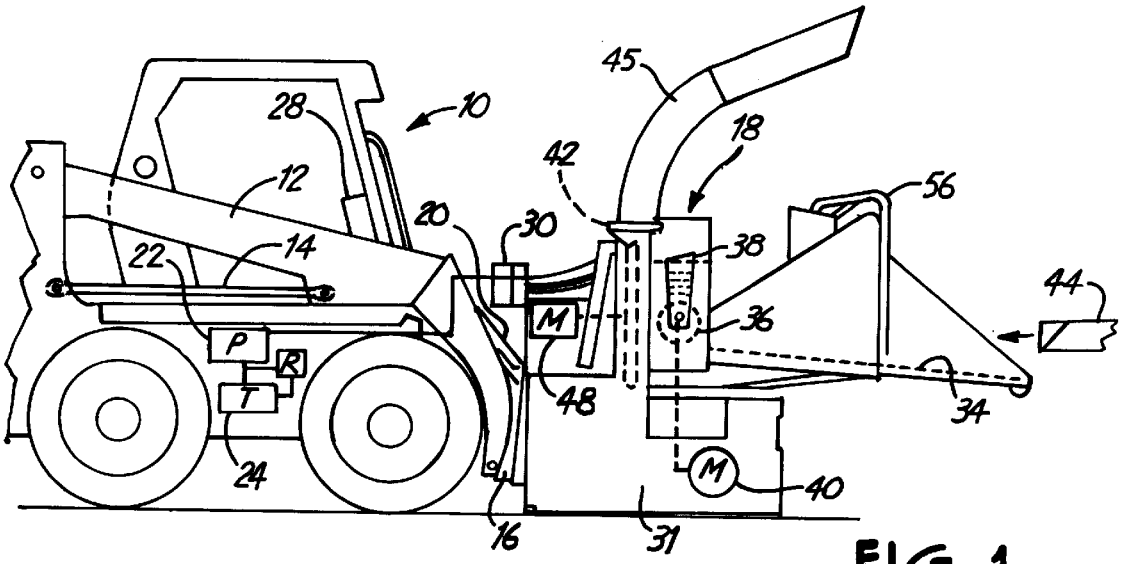
FIG. 1 is a schematic representation of a skid steer loader on which a wood chipper is mounted as an attachment, and having a flow control system made according to the present invention thereon.

A skid steer loader 10, as shown, is provided with lift arms 12, that are controlled with suitable hydraulic actuators 14 for raising and lowering, and the forward end of the lift arms 12. The forward ends of the lift arms mount a standard attachment plate 16 that is used for mounting a wood chipper indicated schematically at 18. The attachment plate 16 is capable of being tilted with an actuator 20 operated from a skid steer loader hydraulic system, which includes a pump 22, and a tank 24. The hydraulic system is the standard system on skid steer loaders that has a control assembly 28 for providing hydraulic fluid under pressure to auxiliary hydraulic couplers 30. Auxiliary hydraulic couplers 30 are used for providing hydraulic fluid under pressure for operating the wood chipper 18.

The wood chipper 18 includes a frame 31 supporting an infeed table 34 for feeding material. A feed roller 36 is mounted at an inner end of feed table 34. The feed roller 36 is mounted on a suitable spring loaded slide 38 or other yieldable mountings, shown only schematically, so it will move up and down to adjust for different size logs or branches in a known manner. The feed roller 36 is driven from a hydraulic motor 40 powered through the auxiliary hydraulic connectors 30. A chipper wheel or rotor 42 is rotatably mounted on a wood chipper frame 31 and is positioned in a manner so blades 43 on the wheel 42 engage and chip a log, branches or brush 44 that is being fed along table 34 by the feed roller 36. There can be two such feed rollers 36 that would hold a log or branch between them, if desired. The chipper wheel 42 is a rotating wheel driven by a hydraulic motor 48, which also is connected to the auxiliary hydraulic connectors 30 for auxiliary attachments leading from the pump 22. The chips are discharged from a spout 45 that can be directed as desired.

Figure 2:
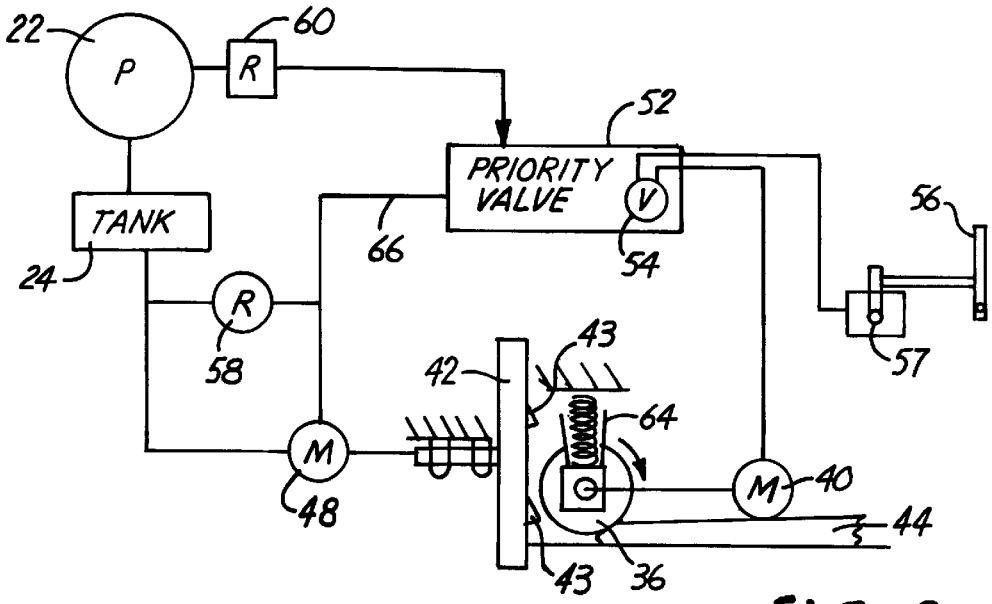
FIG. 2 is a block diagram schematic of the flow control system of the present invention.

In FIG. 2 a simplified block diagram is illustrated, showing the wood chipper wheel 42 in position to receive and engage an end of a log or branch 44 driven by the feed wheel 36, along the table 34. The chipper wheel 42 rotates against the log and blades 43 remove chips from the log or branch and discharge them from the chipper.

FIG. 2 shows the hydraulic pump 22 providing fluid under pressure to both motors 40 and 48 through a priority valve 52 of conventional design. The priority valve 52 divides the flow between the chipper wheel motor 48, and provides priority of flow (the first gallonage less than full flow) to motor 48 and excess flow to the motor 40 for the feed wheel 36. A control valve 54 is provided as part of valve 52 in a line 66B from a proportioning valve 55 (FIG. 3) to direct the secondary flow from priority valve 52 to the motor 40. Valve 54 is a solenoid valve and can be controlled by a lever 56. The valve 54 has a normal center position where the feed wheel 36 can free wheel, that is, the motor 40 can rotate from external loads in either direction, and two other positions to drive the motor 40 selectively in forward and reverse. In another embodiment, feed wheel 36 can be blocked from rotating when valve 54 is in the normal center position. Lever 56 is positioned adjacent to the end of the infeed chute, as shown in FIG. 1 schematically, and in FIG. 2 so that the operator can quickly reverse the feed wheel 36 if desired. The lever 56 operates switches 57 (FIG. 2) that individually control solenoids Si or S2 which are shown in FIG. 3.

Priority valve 52 is made so that as load on motor 48 increases beyond power of the engine, the proportion valve 55, which is an internal part of valve 52 causes the amount of flow provided to motor 40 to reduce, so that the feed wheel 36 will automatically slow down the rate of feed of a log or branch 44 into the chipper wheel 42, thus reducing the load on the chipper wheel.

There is a separate relief valve 58 for the hydraulic circuit for motor 48, in the priority output line 74 of priority valve 52 leading to the motor 48. Relief valve 58 is set lower than the skid steer hydraulic system relief valve 60 on the skid steer loader 10. The system relief valve 60 provides fluid under pressure to the motor 40 for the feed wheel 36 even if relief valve 58 opens, so the feed wheel 36 can be reversed by the operator. This setting permits providing flow to the feed wheel motor 40 for reversing the feed wheel 36 and backing out a branch or log that may be jammed against the chipper wheel 42 keeping it from freely rotating.

Figure 3:
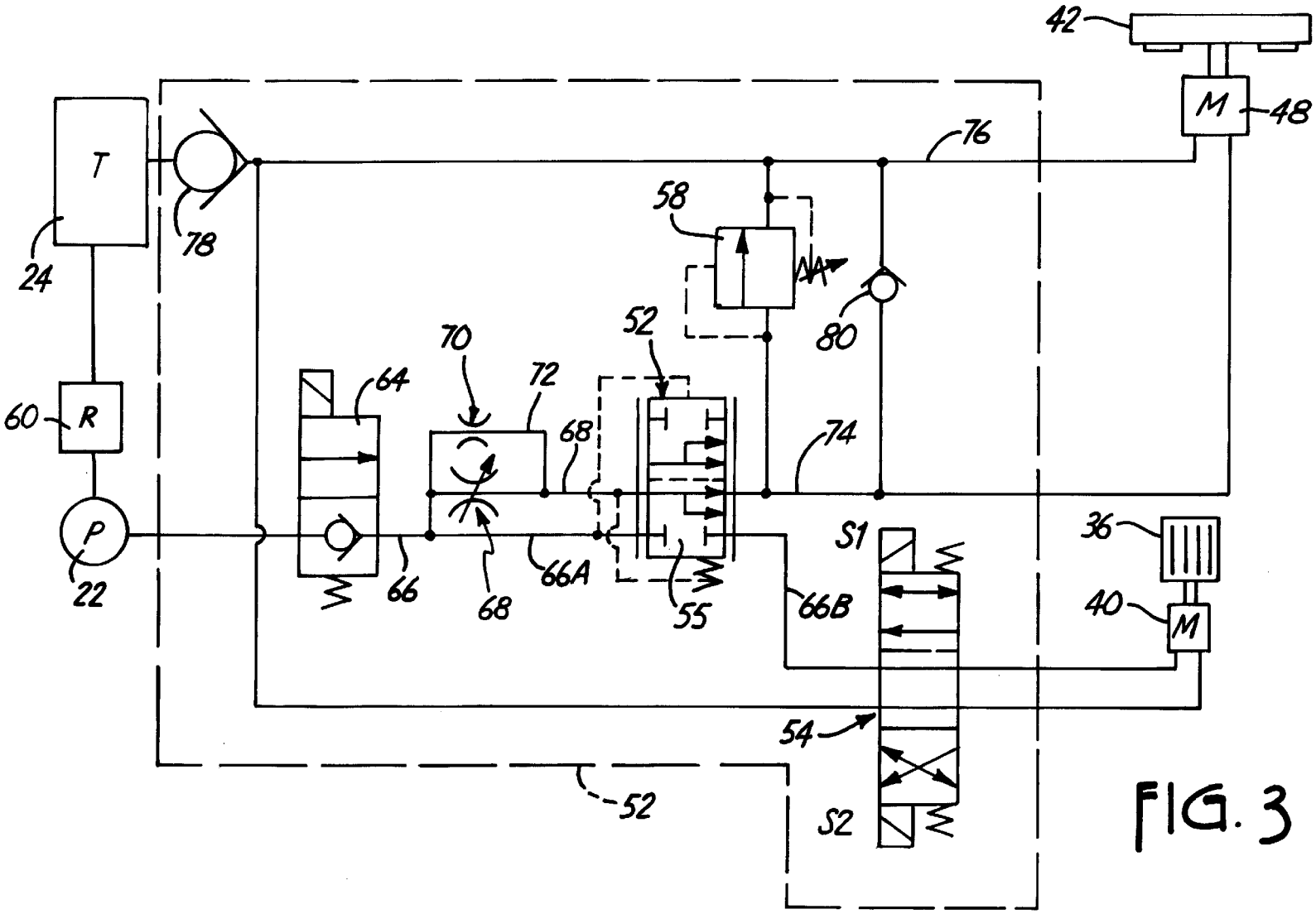
FIG. 3 is a detailed schematic representation of the hydraulic circuit of the present invention.

Referring to FIG. 3, the hydraulic circuit is shown in more detail. The pump 22 is connected through a solenoid operated interface valve 64 that will be moved, when energized, to a position directing flow to a line 66. The controls for the valve 64 and other valves used are located in position to be operable by an operator of the chipper attachment.

The line 66 is connected to the input of the priority flow valve 52, through parallel orifices including a manually adjustable needle valve 68 in parallel with a fixed minimum flow orifice 70 in a line 72 leading to proportioning flow valve 55. The priority flow valve 52 is a standard priority flow valve available from many suppliers of hydraulic components. The output of the priority flow valve 52 along the line 74 leading to motor 48 for chipper wheel 42 carries the main or priority flow to the motor 48. The drain line 76 from the motor 48 leads through a reverse flow check valve 78 to the tank 24 on the skid steer loader 10 through the couplers 30 (FIG. 1).

The relief valve 58 is shown across the lines 74 and 76, and a check valve 80 is also provided across those lines so that the chipper wheel 42 can coast, which will cause flow through the check valve 80 from return line 76 to line 74 when any other control valves are shut off. This permits the chipper wheel 42 to coast to a stop or decelerate depending on the spring force of the check valve.

The control valve 54 for the feed wheel motor 40, as shown, can be a solenoid operated control valve that operates either in a neutral position for free wheeling of motor 40, or forward or reverse positions when one or the other of the solenoids S1 and S2 is energized. The valve 54 has output lines leading to the feed wheel motor 40 for the feed wheel 36.

In operation, when the wood chipper 18 is mounted on the loader 10 and the couplers 30 are connected, and the pump 22 is driven, the chipper wheel 42 can be operated by energizing the valve 64 from a main control switch, so that flow occurs through the priority flow control valve 52 to drive the chipper wheel motor 48 and also providing secondary flow to the feed roller motor 40. When the motor 48 becomes loaded because of loads on the chipper wheel 42, the priority flow valve 52 senses this additional load as decreased flow from pump 22 and a decreased pressure drop across orifice 70, and the proportioning valve shifts to decrease flow to the motor 40, thereby slowing the feed roller 36 and automatically seeking to prevent jamming of the chipper wheel 42.

The adjustable needle valve 68 can be adjusted to control the amount of flow to the feed roller motor 40 through the line 66A. However, the chipper wheel motor 48 will always receive priority flow through the minimum flow orifice 70 of priority valve 52. The variable flow occurs from the line 66A to a line 66B on the output side of the priority flow valve 52 through the valve 54.

If the chipper wheel 42 jams, the lever 56 can be operated to control the solenoid valve 54 and reverse the flow to the motor 40 even though the relief valve 58 is open. The motor 48 will be jammed and will not be driving the chipper wheel 42 when relief valve 58 opens. The relief valve 60 of the main hydraulic system on the skid steer loader will be set to a higher pressure than the relief valve 58.

In this way a highly efficient and operable drive for the wood chipper attachment for a skid steer loader is obtained.

Although the present invention has been described with reference to preferred embodiments, workers skilled in the art will recognize that changes may be made in form and detail without departing from the spirit and scope of the invention.

What is claimed is:

1. A wood chipper attachment for a skid steer loader having a chipper wheel and a feed roller for feeding material to the chipper wheel, a first hydraulic motor driving said chipper wheel, a second hydraulic motor driving said feed roller, a priority flow valve receiving flow from a pump and directing an initial portion of the flow to the first hydraulic motor and secondary flow to the second hydraulic motor, said priority flow valve being responsive to loads causing decreased flow to the priority valve by reducing flow to the secondary hydraulic motor as the chipper wheel is loaded.

2. The apparatus of claim 1 and a needle valve and a fixed orifice in parallel on an input side of the priority flow valve to insure a flow volume for the first hydraulic motor.

3. The apparatus of claim 1 including a first relief valve on an input side of the priority valve, a second relief valve connected across flow conduits to said first hydraulic motor, said second relief valve being set to relieve pressure at a lower pressure than the first relief valve.

4. The apparatus of claim 3 and an on/off valve leading from the pump to the priority flow valve.

5. The apparatus of claim 4, wherein the pump and the first relief valve are part of a hydraulic system on the skid steer loader.

6. The apparatus of claim 3 and a reversing valve connected between the priority flow valve and the secondary hydraulic motor to permit reversing the second hydraulic motor and feed roller from a normal infeed direction.

7. The apparatus of claim 3 and control valve between the priority flow valve and the second hydraulic motor having a position to permit the second hydraulic motor to move in either direction of rotation by operator activation of the control valve.

8. The apparatus of claim 1 and a mounting member for mounting the wood chipper on the skid steer loader.

9. A wood chipper auxiliary attachment for a skid steer loader having a hydraulic system including a pump providing flow of hydraulic fluid under pressure for auxiliary attachments, the wood chipper comprising a frame having a rotatable chipper wheel and a feed roller for feeding material to the chipper wheel mounted on the frame, a chipper hydraulic motor driving said chipper wheel, a feed roller hydraulic motor driving said feed roller, a priority flow valve coupleable to the pump on the skid steer loader for receiving flow and directing flow to both the chipper motor and the feed roller motor, said priority flow valve directing an initial volume of flow to the chipper motor and excess of flow above the initial volume to the feed roller motor, a proportional circuit being responsive to loads on the chipper motor and flow available to the priority valve to direct proportionally less flow to the feed roller motor, as the chipper wheel is loaded.

10. The apparatus of claim 9 and a needle valve and a fixed orifice in parallel on an input side of the priority flow valve to direct the initial volume to the chipper motor.

11. The apparatus of claim 9, wherein the hydraulic system on the skid steer loader has a first relief valve, a second relief valve connected across said chipper wheel motor, said second relief valve being set to relieve pressure at a lower pressure than the first relief valve.

12. The apparatus of claim 9 and an on/off valve leading from the pump to the priority flow valve.

13. The apparatus of claim 9 and a mounting member for mounting the wood chipper on the skid steer loader.

14. The apparatus of claim 11 and a reversing valve connected between the priority flow valve and the feed roller motor to permit stopping or reversing the feed roller motor from a normal infeed direction.

15. The apparatus of claim 11 and a control valve between the priority flow valve and the feed roller motor having a first position permitting the feed roller motor to move in a first direction of rotation from external forces on the second hydraulic motor, and a second position to direct flow to the feed roller motor to stop the feed roller motor and a third position to cause rotation of the feed roller motor in an opposite direction.

16. The apparatus of claim 9 and a one-way check valve connected across input and output conduits for said chipper motor to permit recirculating flow through the chipper motor when the chipper wheel inertia provides rotational force tending to drive the chipper wheel.

17. The apparatus of claim 16 and further comprising a spring coupled to the one-way check valve to decelerate the chipper motor.

* * * * *